US006161816A

United States Patent [19]

Kikuchi

[11] Patent Number: 6,161,816

[45] Date of Patent: Dec. 19, 2000

[54] PANTAGRAPH-TYPE JACK, AND PROCESS FOR PRODUCING THE SAME

[75] Inventor: Noriyuki Kikuchi, Kumagaya, Japan

[73] Assignee: Rikenkaki Kogyo Kabushiki Kaisha, Saitama, Japan

[21] Appl. No.: 09/474,759

[22] Filed: Dec. 30, 1999

[30] Foreign Application Priority Data

Apr. 15, 1999 [JP] Japan ..... 11-107561

[51] Int. Cl.[7] ..... B66F 3/08

[52] U.S. Cl. ..... 254/126; 254/122

[58] Field of Search ..... 254/126, 122, 254/98, 100, 101, 124

[56] References Cited

U.S. PATENT DOCUMENTS

| | | | |
|---|---|---|---|
| 535,314 | 3/1895 | Barlett et al. | 151/14 |
| 2,783,809 | 3/1957 | Haines | 151/14 |
| 4,732,366 | 3/1988 | Suga | 254/126 |
| 5,176,362 | 1/1993 | Seksaria et al. | 254/126 |
| 5,303,898 | 4/1994 | Engel et al. | 254/126 |
| 5,435,522 | 7/1995 | Brosius | 254/126 |
| 5,529,286 | 6/1996 | Kikuchi | 254/126 |
| 5,950,990 | 9/1999 | Castillo | 254/126 |
| 5,975,497 | 11/1999 | Few et al. | 254/126 |

FOREIGN PATENT DOCUMENTS 3-6120 1/1991 Japan .

*Primary Examiner*—Derris H. Banks
*Assistant Examiner*—Lee Wilson
*Attorney, Agent, or Firm*—Arent Fox Kintner Plotkin & Kahn, PLLC

[57] ABSTRACT

A pantagraph-type jack includes a pair of lower arms and a pair of upper arms. Upper ends of the lower arms and lower ends of the upper arms are connected to each other through first and second connecting shafts. An externally threaded rod is rotatably but axially non-movably supported on the first connecting shaft and threadedly engaged with a threaded bore provided in the second connecting shaft. In the pantagraph-type jack, the externally threaded rod is formed into a hollow shape, and external threads of the externally threaded rod are provided with a tapered portion formed in a convergent shape over a given light-loaded area from a tip end on the side of the second connecting shaft. Thus, a reduction in weight of the externally threaded rod can be provided, and the threaded engagement of the externally threaded rod with the threaded bore in the second connecting shaft can be conducted easily, which contributes to a reduction in weight and an enhancement in assemblability.

1 Claim, 4 Drawing Sheets

PANTAGRAPH-TYPE JACK, AND PROCESS FOR PRODUCING THE SAME

BACKGROUND OF THE INVENTION

1. Field of the Invention

The present invention relates to a pantagraph-type jack comprising a pair of lower arms disposed in an upward divergent shape and swingably connected at lower ends thereof to a pedestal, a pair of upper arms disposed in a downward divergent shape and swingably connected at upper ends thereof to load receiving base, upper ends of the lower arms and lower ends of the upper arms being connected to each other through first and second connecting shafts, respectively, and an externally threaded rod rotatably but axially non-movably supported on the first connecting shaft and threadedly engaged with a threaded bore provided in the second connecting shaft, and to a process for producing such a pantagraph-type jack.

2. Description of the Related Art

Such pantagraph-type jacks are already known, as disclosed, for example, in Japanese Patent Publication No. 3-6120.

Such a pantagraph-type jack is equipped in an automobile in many cases and hence, there is a strong demand for reducing the weight of the pantagraph-type jack. As disclosed in the above-described publication, however, in the known pantagraph-type jack, the externally threaded rod is formed of a solid and very weighty rounded rod, which is an obstacle to a reduction in weight.

SUMMARY OF THE INVENTION

Accordingly, it is an object of the present invention to provide a pantagraph-type jack of the above-described type, wherein a reduction in weight of the externally threaded rod can be provided, and the threaded engagement of the externally threaded rod with the threaded bore in the second connecting shaft can be conducted easily, thereby simultaneously providing a reduction in weight and an enhancement in assemblability, and to provide a process for producing such a pantagraph-type jack.

To achieve the above object, according to a first aspect and feature of the present invention, there is provided a pantagraph-type jack comprising a pair of lower arms disposed in an upward divergent shape and swingably connected at their lower ends thereof to a pedestal, a pair of upper arms disposed in a downward divergent shape and swingably connected at upper ends thereof to a load receiving base, upper ends of the lower arms and lower ends of the upper arms being connected to each other through first and second connecting shafts, and an externally threaded rod rotatably but axially non-movably supported on the first connecting shaft and threadedly engaged with a threaded bore provided in the second connecting shaft, wherein the externally threaded rod is formed into a hollow shape, and external threads of the externally threaded rod are provided with a tapered portion formed in a convergent shape over a given light-loaded area from a tip end on the side of the second connecting shaft.

With the first feature, a remarkable reduction in weight of the externally threaded rod can be provided by the formation of the externally threaded rod in the hollow shape, as compared with the known solid externally threaded rod. This can contribute largely to a reduction in weight of the pantagraph-type jack.

When the externally threaded rod is threadedly engaged with the threaded bore in the second connecting shaft during assembling of the pantagraph-type jack, the threaded engagement of the externally threaded rod with the threaded bore in the second connecting shaft can be conducted easily and precisely due to the inducing action of the tapered portion of the external threads. This can enhance the assembling efficiency and contribute to a reduction in cost.

Moreover, when the externally threaded rod is rotated to lift the load receiving base to a certain extent, the tapered portion of the external threads is moved past the second connecting shaft, so that a straight portion of the external threads is brought into threaded engagement with the second connecting shaft. Therefore, the external threads can sufficiently withstand a load applied to the load receiving base, and hence, a durability is ensured.

According to a second aspect and feature of the present invention, there is provided a process for producing a pantagraph-type jack, comprising the steps of fabricating from a hollow pipe the externally threaded rod by forming the external threads on an outer peripheral surface of the hollow pipe by rolling, and bringing the externally threaded rod into threaded engagement with a threaded bore in a second connecting shaft from an end of the external threads at which the rolling is started.

With the second feature, by properly selecting the thickness of the hollow pipe, the pressure applied to the hollow pipe by rotary dies and the like, the externally threaded rod having the convergent tapered portion formed in a light-loaded area of the external threads can be fabricated. Therefore, a special taper-forming treatment is not required, and the rod can be provided at a low cost.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of one embodiment with reference to the accompanying drawings.

Figure 1:
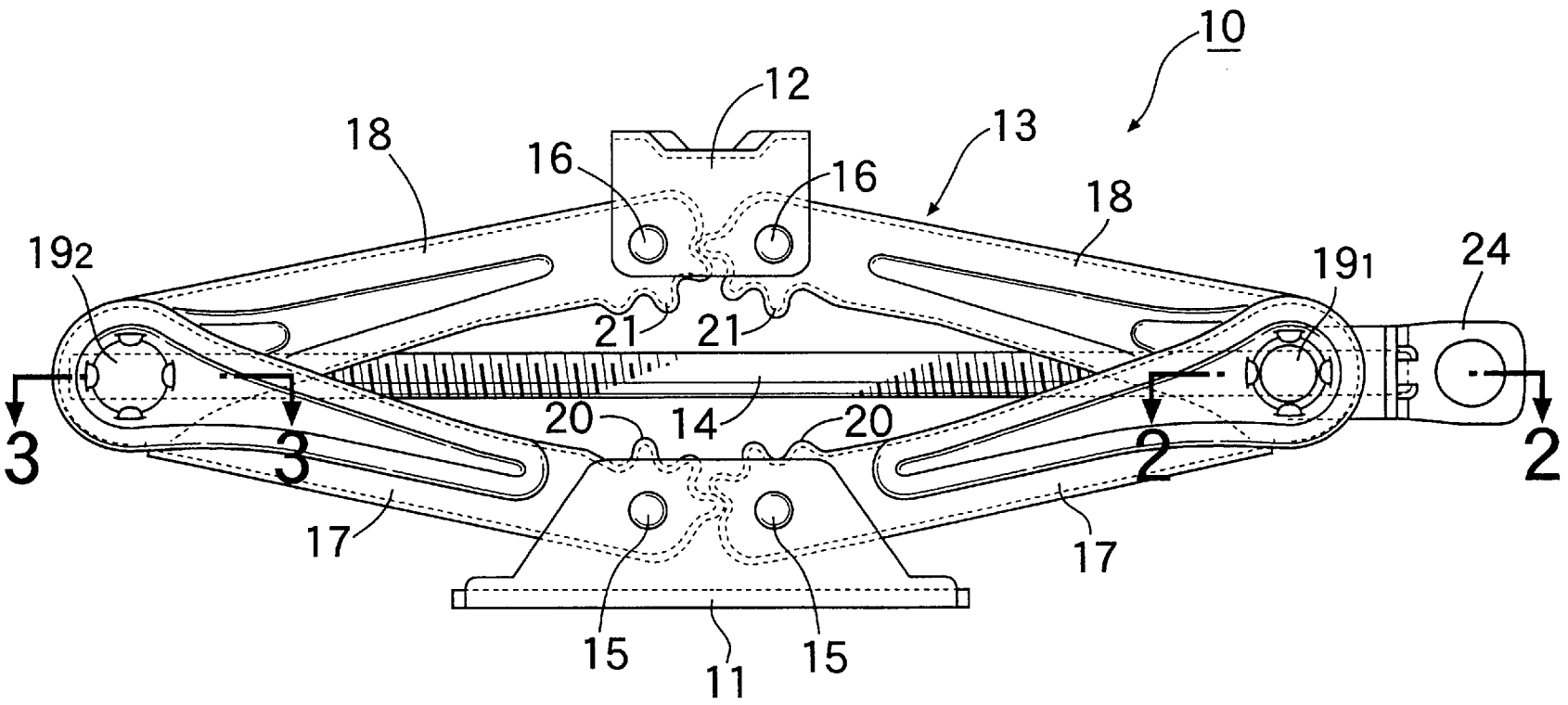
FIG. 1 is a side view of a pantagraph-type jack 10 according to an embodiment the present invention.
Figure 2:
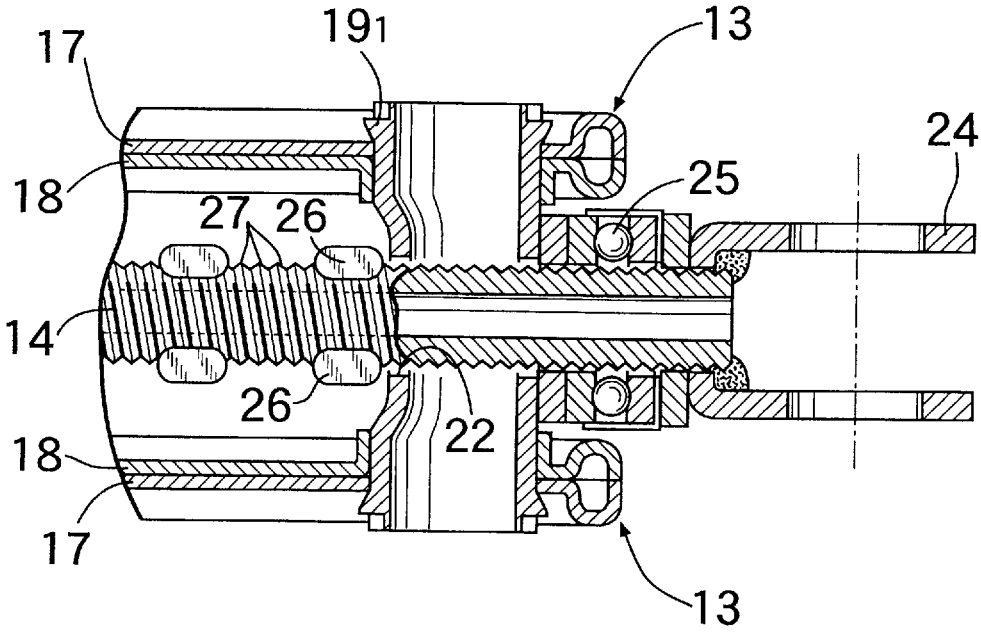
FIG. 2 is A sectional view taken along a line 2—2 in FIG. 1.
Figure 3:
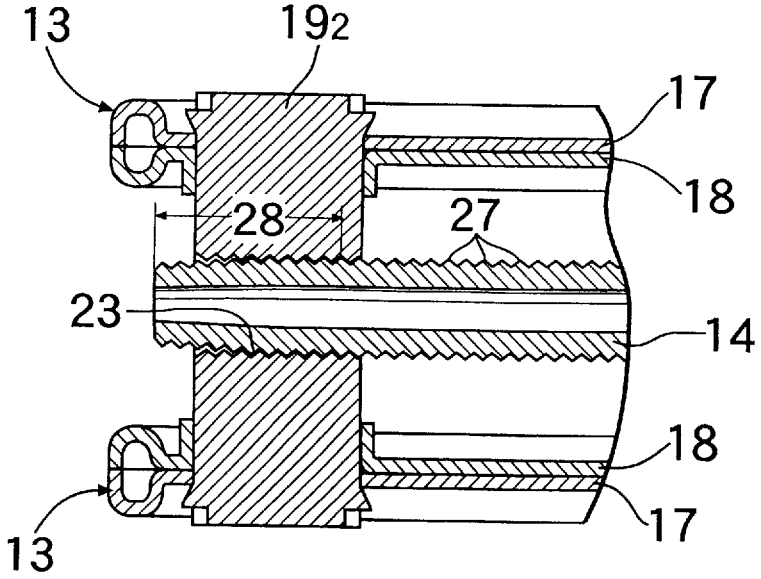
FIG. 3 is a sectional view taken along a line 3—3 in FIG. 1.

Referring first to FIGS. 1 to 3, a jack 10 is a so-called pantograph type with four link arms connected together in a pantagraphic manner, and includes a pedestal 11, a load receiving base 12 disposed immediately above the pedestal 11, a link mechanism 13 which connects the pedestal 11 and the load receiving base 12 to each other, and an externally-threaded rod 14 for lifting and lowering the load receiving base 12 by driving the link mechanism 13.

The link mechanism 13 is comprised of a pair of left and right lower arms 17, 17 disposed in an upward divergent shape and swingably connected at their lower ends to the pedestal 11 through a pair of left and right lower pivots 15, 15, a pair of left and right upper arms 18, 18 disposed in a downward divergent shape and swingably connected at their upper ends to the load receiving base 12 through a pair of left and right upper pivots 16, 16, a first connecting shaft $19_1$ for interconnecting the upper and lower ends of the lower and upper arms 17 and 18 on one side for swinging movement, and a second connecting shaft $19_2$ for interconnecting the upper and lower ends of the lower and upper arms 17 and 18 on the other side for swinging movement. Such two pairs of front and rear link mechanisms 13 are disposed by commonly using the lower pivots 15, 15, the upper pivots 16, 16 and the first and second connecting shafts $19_1$ and $19_2$.

Each of the link mechanisms 13, sector gears 20, 20 meshed with each other are formed at the lower ends of the left and right lower arms 17, 17, and sector gears 21, 21 meshed with each other are formed at the upper ends of the left and right upper arms 18, 18.

As shown in FIGS. 2 and 3, the first connecting shaft $19_1$ is made of a hollow pipe, and has a shaft bore 22 provided perpendicularly to its axis at its central portion. The second connecting shaft $19_2$ is solid and has a threaded bore 23 perpendicularly to its axis at its central portion. The externally threaded rod 14 is rotatably fitted at one end thereof into the shaft bore 22, and threadedly engaged at the other end thereof with the threaded bore 23.

A yoke joint 24 is secured by welding to one end of the externally threaded rod 14 on the side of the first connecting shaft $19_1$, and a thrust bearing 25 is mounted adjacent the yoke joint 24. The externally threaded rod 14 is axially non-movably connected to the first connecting shaft $19_1$ by disposing the thrust bearing 25 and a projection 26 bulged on an outer peripheral surface of the externally threaded rod 14 in abutment against opposite sides of the first connecting shaft $19_1$.

Thus, if the externally threaded rod 14 is rotated in a normal or reverse direction by a rotating tool (not shown) connected to the yoke joint 24, the lower arms 17, 17 and the upper arms 18, 18 can be swung in a standing-up direction or in a falling-down direction with movements of the first and second connecting shafts $19_1$ and $19_2$ toward and away from each other, thereby lifting or lowering the load receiving base 12. In this case, the load receiving base 12 can be lifted and lowered, while always maintaining the horizontal attitude without being inclined with respect to the pedestal 11, because the sector gears 20, 20 at the lower ends of the left and right lower arms 17, 17 are meshed with each other and the sector gears 21,21 at the upper ends of the left and right upper arms 18, 18 are also meshed with each other.

Figure 4:
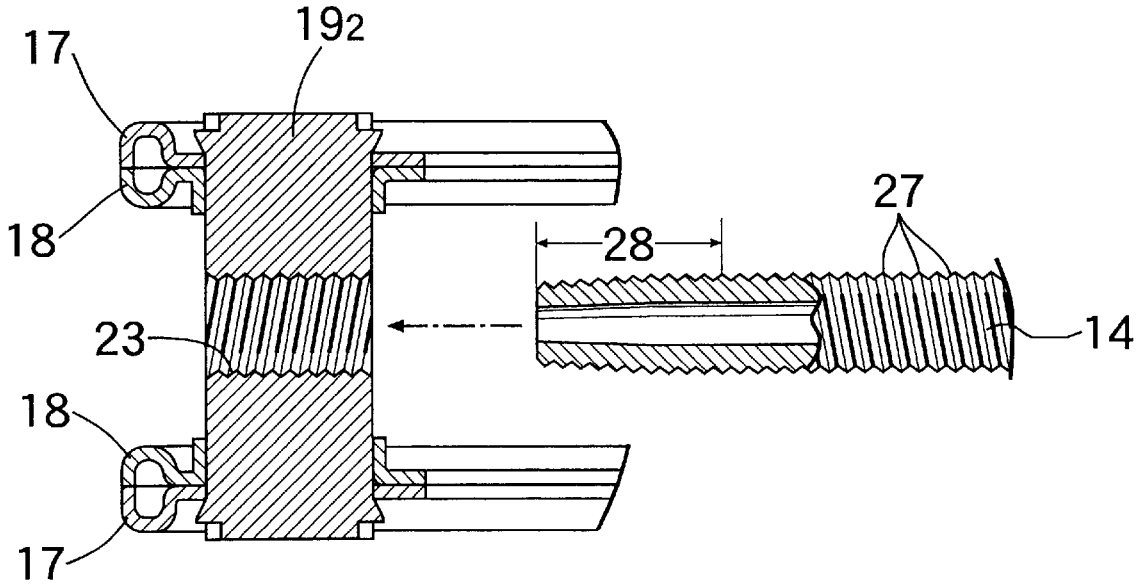
FIG. 4 is an exploded view similar to FIG. 3.

As shown in FIGS. 2 to 4, the externally threaded rod 14 is made of a hollow pipe, and a convergently tapered portion 28 is formed over a given light-loaded area of external threads 27 from a tip end on the side opposite from the yoke joint 24 on an outer peripheral surface of the externally threaded rod 14 (see FIGS. 3 and 4).

In this way, the externally threaded rod 14 is formed into a hollow shape and hence, the weight of the externally threaded rod 14 can be reduced substantially, as compared with the conventional solid externally threaded rod, which can contribute largely to a reduction in weight of the pantagraph-type jack 10.

In addition, the convergent tapered portion 28 is formed on the external threads 27 of the externally threaded rod 14 at the tip end on the side of the second connection shaft $19_2$ and hence, when the externally threaded rod 14 is to be threadedly engaged with the threaded bore 23 in the second connecting shaft $19_2$ during assembling of the pantagraph-type jack 10, the engagement of the externally threaded rod 14 with the threaded bore 23 can be conducted easily and precisely due to the inducing action of the tapered portion 28. Therefore, it is possible to provide an increase in assembling efficiency and contribute to a reduction in cost.

Moreover, the tapered portion 28 is provided in the light-loaded area of the external threads 27, and hence, when the externally threaded rod 14 is rotated in the normal direction to lift the load receiving base 12 to a certain extent and the load receiving base 12 receives a load, the tapered portion 28 of the external threads 27 is moved past the second connecting shaft $19_2$, so that a usual straight portion of the external threads 27 is brought into threaded engagement with the threaded bore 23 in the second connecting shaft $19_2$. Thus, the external threads 27 can sufficiently withstand a load applied to the load receiving base 12.

Figure 5:
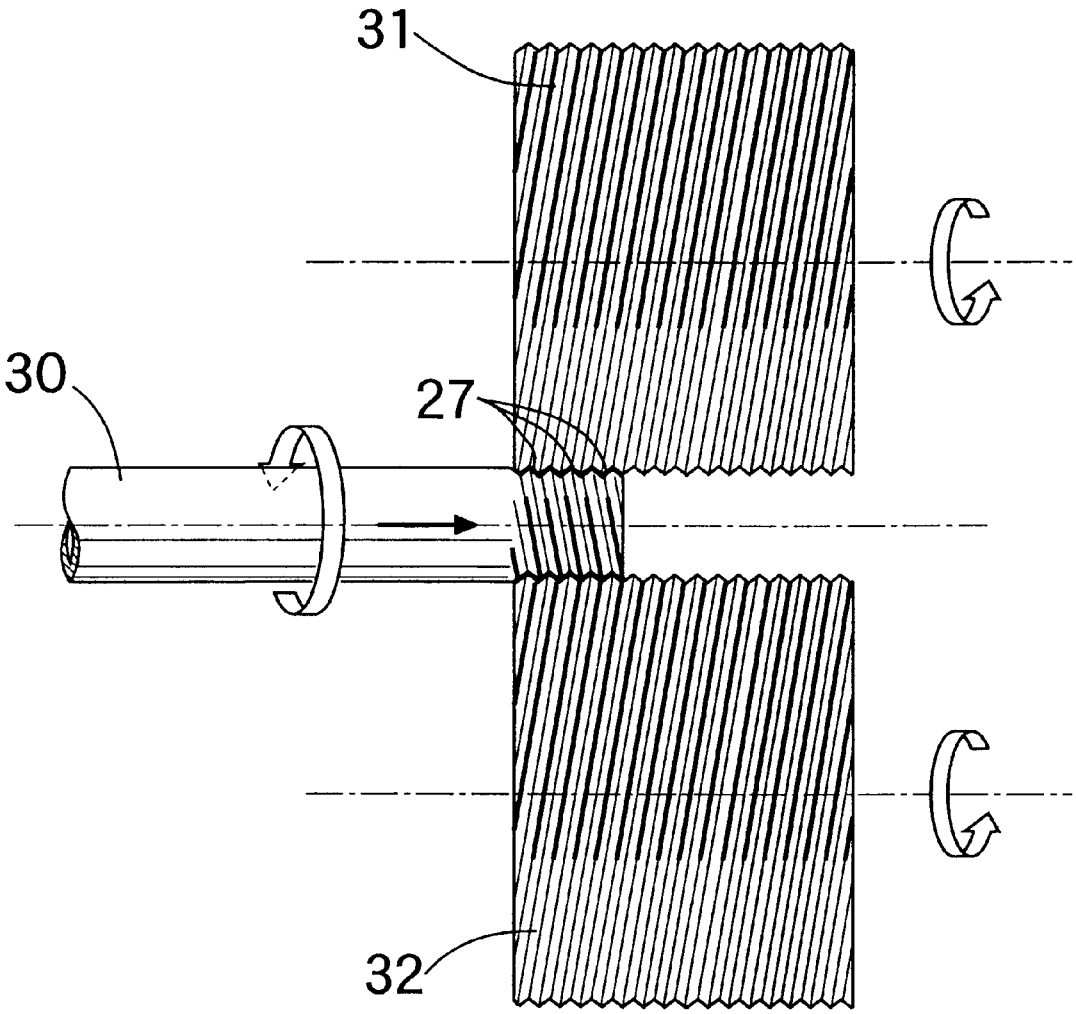
FIG. 5 is a view for explaining the step of forming external threads of an externally threaded rod in a rolling manner.

A process for producing the externally threaded rod 14 will be described below with reference to FIG. 5.

A hollow pipe 30 having a defined length is prepared as a material for the externally threaded rod 14 and inserted from one end side between a pair of rotary dies 31 and 32 of a known screw rolling disc. The rotary dies 31 and 32 are rotated in the same direction and hence, the hollow pipe 30 is rotated in the direction opposite from the direction of rotation of the rotary dies and at the same time, is moved from one ends of the rotary dies 31 and 32 toward the other ends, whereby the external threads 27 are plastically formed on the outer peripheral surface of the rod 14 by threads of the rotary dies 31 and 32.

An open end of the hollow pipe 30 is relatively liable to be deformed by a compressing force applied from a radial direction. Moreover, an end of the external threads 27 at which the rolling is started, receives a high pressure from the rotary dies 31 and 32 because of a small rolled area arid hence, a convergent tapered portion 28 is naturally formed on the external threads 27 over a certain area from the end at which the rolling is started. According to the embodiment of the present invention, by utilizing such a phenomenon and by properly selecting the thickness of the hollow pipe 30, the pressure applied to the hollow pipe 30 by the rotary dies 31 and 32 and the like, it is ensured that an area of the tapered portion 28 is matched with the light-loaded area of the external threads 27. Thus, the externally threaded rod 14 having the convergent tapered portion 28 on the light-loaded area of the external threads 27 can be produced at a low cost without utilization of a special taper-forming treatment.

After the formation of the external threads 27 by rolling, the yoke joint 24 is welded to the end of the externally threaded rod 14 at which the rolling is finished, i.e., the end on the side opposite from the tapered portion 28.

The externally threaded rod 14 having the yoke joint 24 welded in the above manner to the end at which the rolling is finished, can be threadedly engaged necessarily easily with the threaded bore 23 in the second connecting shaft $19_2$ from the tip end formed with the tapered portion 28 during assembling of the pantagraph-type jack 10. Thus, a mis-assembling can be prevented.

Although the embodiment of the present invention has been described in detail, it will be understood that the present invention is not limited to the above-described embodiment, and various modifications may be made without departing from the spirit and scope of the invention defined in claims.

What is claimed is:

1. A pantagraph-type jack comprising a pair of lower arms disposed in an upward divergent shape and swingably connected at lower ends thereof to a pedestal, a pair of upper arms disposed in a downward divergent shape and swingably connected at upper ends thereof to a load receiving base, upper ends of said lower arms and lower ends of said upper arms being connected to each other through first and second connecting shafts, respectively, and an externally threaded rod rotatably but axially non-movably supported on said first connecting shaft and threadedly engaged with a threaded bore provided in said second connecting shaft, wherein said externally threaded rod is formed into a hollow shape, and external threads of said externally threaded rod are provided with a tapered portion formed in a convergent shape over a given light-loaded area from a tip end on the side of said second connecting shaft.

* * * * *